United States Patent [19]

Takahashi

[11] Patent Number: 4,995,291

[45] Date of Patent: Feb. 26, 1991

[54] ACTION MECHANISM FOR THE PIANO

[75] Inventor: Fumitaka Takahashi, Shizuoka, Japan

[73] Assignee: Kawai Gakki Seisakusho Co., Ltd., Hamamatsu, Japan

[21] Appl. No.: 397,897

[22] Filed: Aug. 24, 1989

[30] Foreign Application Priority Data

Aug. 29, 1988 [JP] Japan ..... 63-112070[U]

[51] Int. Cl.[5] ..... G10C 3/18

[52] U.S. Cl. ..... 84/237

[58] Field of Search ..... 84/236, 237, 239, 238, 84/240, 241, 243, 404

[56] References Cited

U.S. PATENT DOCUMENTS

| | | | |
|---|---|---|---|
| 210,223 | 11/1898 | Plass | 84/243 X |
| 237,797 | 2/1881 | Ammon | 84/243 |
| 658,284 | 9/1900 | Schoenhut | 84/404 |
| 1,404,428 | 7/1973 | Newman et al. | 84/241 |
| 1,423,024 | 7/1922 | Roberts | 84/404 |
| 1,866,153 | 7/1932 | Cameron, Jr. | 84/239 |
| 2,280,982 | 4/1942 | Schulze | 84/239 |
| 3,554,071 | 1/1971 | Klaiber | 84/236 |
| 3,621,105 | 11/1971 | Takamatsu | 84/1.16 |
| 3,651,732 | 3/1972 | Erbert et al. | 84/236 |
| 4,685,371 | 8/1987 | Levinson | 84/23.9 |
| 4,774,868 | 10/1988 | Finholm | 84/236 |

FOREIGN PATENT DOCUMENTS

| | | | |
|---|---|---|---|
| 46-30775 | 10/1971 | Japan . | |
| 49-3286 | 1/1974 | Japan . | |
| 49-32621 | 3/1974 | Japan . | |
| 53-125535 | 10/1978 | Japan . | |
| 59-104195 | 7/1984 | Japan . | |
| 62-25993 | 2/1987 | Japan . | |
| 325631 | 2/1930 | United Kingdom | 84/404 |

*Primary Examiner*—Brian W. Brown

*Attorney, Agent, or Firm*—Fleit, Jacobson, Cohn, Price, Holman & Stern

[57] ABSTRACT

An action mechanism for the piano in which a jack is resiliently and rotatably mounted on a rear portion of a key, a jack receiver and a push-out protrusion are provided on a hammer support member that is rotatably mounted at its one end on a hammer shank rail via a flange over the key, and when the key is depressed, the hammer is turned toward the sound producing member owing to the engagement of the tip of said jack and said jack receiver and, at the same time, the engagement between the jack and the jack receiver is released by the push-out protrusion.

6 Claims, 4 Drawing Sheets

ACTION MECHANISM FOR THE PIANO

BACKGROUND OF THE INVENTION

1. Field of the Invention

The present invention relates to an action mechanism of a simplified construction for the piano.

2. Description of Related Art

FIG. 6 schematically illustrates the action of a grand piano that is now most widely used, wherein when a key K is depressed, a wippen W whose rear end is pivotted to a flange f on a wippen rail R is pushed up via a capstan screw s studded to a central portion of the key K and a wippen heel $W_1$ whereby the motion of the wippen W is transmitted to an L-shaped jack j pivotted to the front end of the wippen W, and an upper end $j_1$ penetrates through an elongated hole of a repetition lever l to knock up a roller r attached to a hammer shank $h_1$, such that a hammer h is driven toward a string g to strike it.

In the conventional action mechanism, the force of a finger depressing a key is transmitted from the key to the wippen, from the wippen to the jack, from the jack to the hammer shank, and the force is finally transformed into a rotational motion of the hammer for producing a particular sound. With such a mechanism, a peculiar touch feeling is obtained in playing the piano. With the above method, however, the aforementioned series of mechanisms is required for every key. Therefore, a very large number of parts are required, the mechanism becomes complex and is assembled needing laborious work. Moreover, cushioning member is used in large amounts, and variance in the machining of the parts and lack of rigidity result in an increase in the transmission loss of the key-depressing force.

SUMMARY OF THE INVENTION

The object of the present invention therefore is to provide an action mechanism which is simple in construction, which can be easily fabricated, and which permits the transmission of key-depressing force to be lost little yet maintaining touch feeling of the piano.

To achieve the above object, the present invention deals with an action mechanism for the piano in which a jack is mounted on a rear portion of the key, the jack being resiliently urged and is rotatable, a jack receiver and a push-out protrusion are formed on a hammer support member that is rotatably mounted at its one end on a hammer shank rail via a flange over the key, and the engagement between the jack and the jack receiver is released by the push-out protrusion when the key is depressed.

In playing the piano, when a front end of the key is depressed, the rear end thereof moves upwards and the upper end of the jack mounted thereon knocks up the hammer support member via the jack receiver. Accompanying the upward turn, therefore, the push-out protrusion hits the jack to displace it in the counterclockwise direction so that the engagement of the jack and the jack receiver is released.

BRIEF DESCRIPTION OF THE DRAWINGS

FIG. 5(*b*) is a bottom view of the hammer body of FIG. 3; and

DESCRIPTION OF THE PREFERRED EMBODIMENTS

Figure 1:
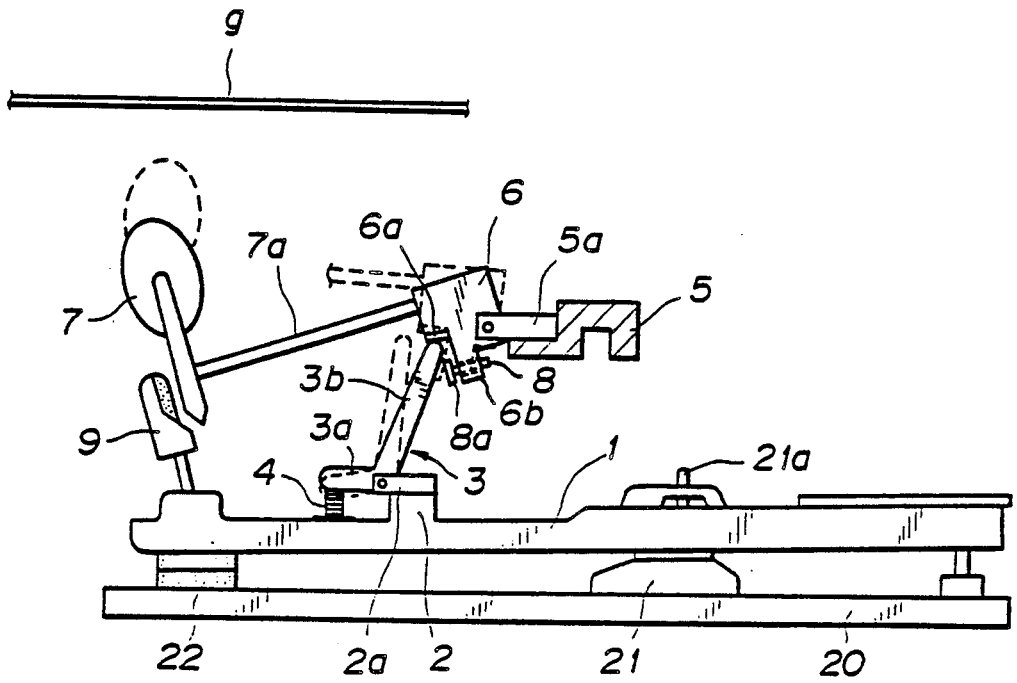
FIG. 1 is a side view illustrating an embodiment of the present invention.
Figure 2:
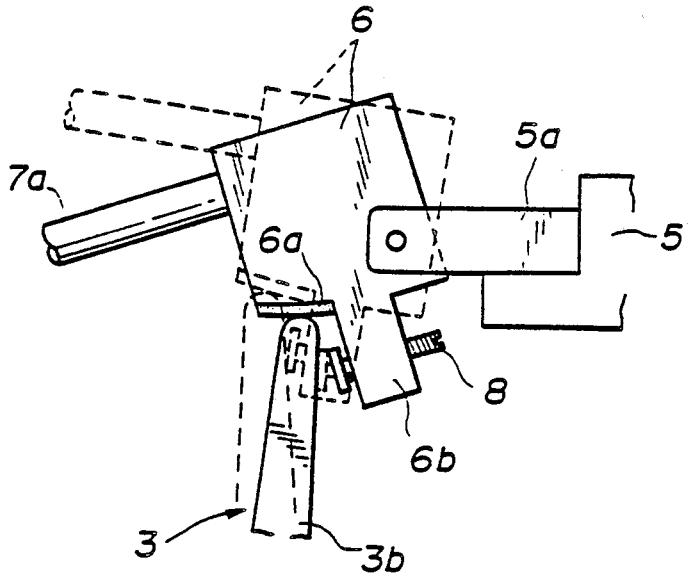
FIG. 2 is a side view illustrating on an enlarged scale a portion where the hammer shank is mounted.

FIGS. 1 and 2 illustrate an embodiment of the present invention, wherein reference numeral 1 denotes a key which is arranged to swing up and down via a balance pin 21*a* on a balance rail 21 that is provided on the central portion of a key frame 20. An upwardly erected post 2 is provided at a central portion of the rear half of the key, i.e., at a central position between the balance rail 21 and a rear key rest 22. On the upper end of the post 2 is mounted a sidewardly oriented flange 2*a* that protrudes rearwardly. At the protruded end of the flange 2*a* is rotatably pivoted the apex portion of an L-shaped jack 3 so as to turn forwardly (in the clockwise direction) under the biasing action of a spring 4 of a required strength that is arranged between the lower surface of jack at the rear end of the lateral leg 3*a* of the jack 3 and the key 1.

Over the rear half of the key 1, furthermore, a sidewardly oriented shank flange 5*a* is mounted to protrude rearwardly from a hammer shank rail 5 extending in a direction disposed at right angles to key 1. At the protruded end of the shank flange 5*a* is rotatably pivoted the front lower corner of a bat 6 mounted on a hammer shank 7*a* as a unitary structure thereof and comprising the base end of hammer shank 7*a*. The bat 6 has a nearly right-angled jack receiver or seal 6*a* at its lower rear portion, incorporating a downwardly directed push-out protrusion or abutment 6*b*, and an inversely protruded side surface. When the piano is not being played, the upper end of a vertical leg 3*b* of the jack 3, which is resiliently urged in the clockwise direction, comes into engagement with the jack receiver or seal 6*a*, whereby the bat 6 and the hammer shank 7*a* are tilted rearwardly and downwardly such that the hammer 7 is held under a string g. It is also allowable to rotatably mount the bat 6 directly on the hammer shank rail 5 without interposing the shank flange 5*a*.

Reference numeral 8 denotes an adjusting screw provided on and comprising an adjustable portion the push-out protrusion or abutment 6*b* to suitably adjust the left-off timing of the jack 3, and 9 denotes a backcheck for absorbing the return motion of the hammer 7.

In playing the piano, when the front end of the key 1 is depressed, the rear half portion thereof is pushed up and the jack 3 provided on the rear half portion is pushed up, also. Then, the upper end of the vertical leg 3*b* of the jack 3 knocks up the bat 6 w is then turned in the clockwise direction as indicated by phantom line (as best shown in FIG. 2).

As the bat 6 is turned, the head 8*a* of the adjusting screw 8 provided in the protrusion or abutment 6*b* on the lower side hits the upper end of the vertical piece 3*b* of the jack. Therefore, the jack 3 is rotated in the counterclockwise direction against the resilient force of the spring 4 whereby the bat 6 is positively disengaged from the jack receiver 6a which is a so-called let-off. This operation gives a peculiar key touch feeling to the player, and the hammer 7 is forcefully rotated, by inertia, toward the string g via the hammer shank 7a to hit the string 9.

Then, as the hammer 7 and the bat 6 are reversed to return, the jack 3 returns to the condition indicated by a solid line in the drawing owing to the restoring force of the spring 4 after the finger is separated away from the key 1, and the upper end of the jack 3 comes into engagement with the jack receiver 6a of the bat 6 as in the initial condition. The let-off timing of the jack 3 from the bat 6 can be adjusted by turning the adjusting screw 8.

Figure 3:
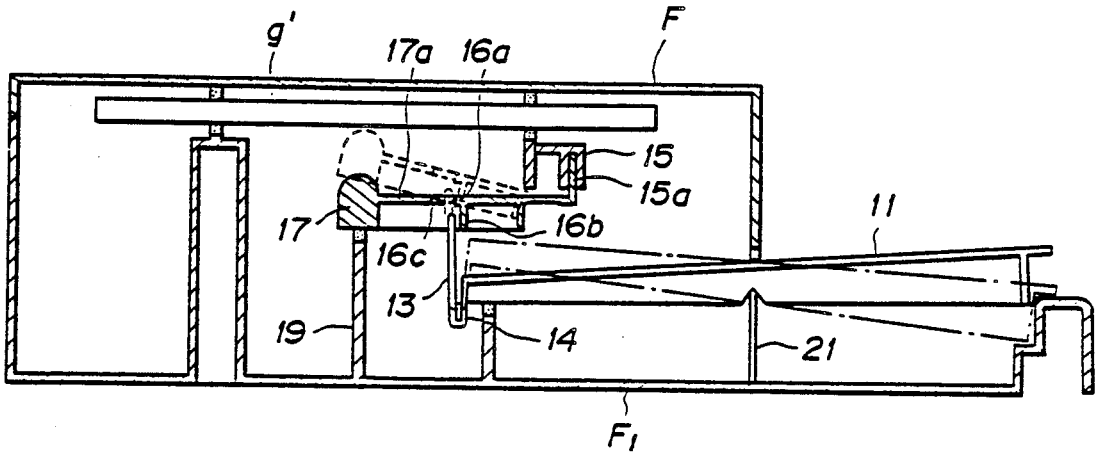
FIG. 3 is acute-away side view illustrating another embodiment.
Figure 4:
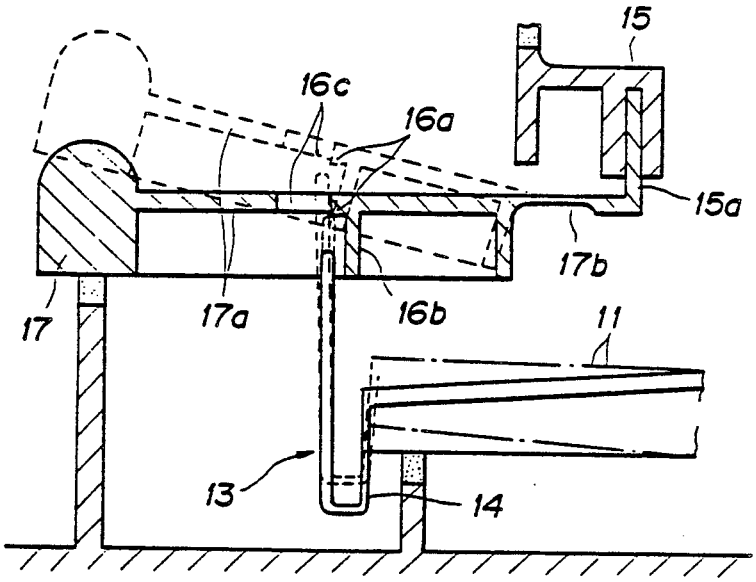
FIG. 4 is a side view showing on an enlarged scale the rear portion of the key and the hammer portion of the embodiment of FIG. 3.
Figure 5A:
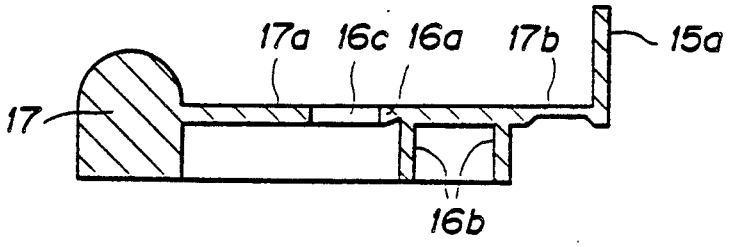
FIG. 5(*a*) is a section view of the hammer body of FIG. 3.
Figure 5B:
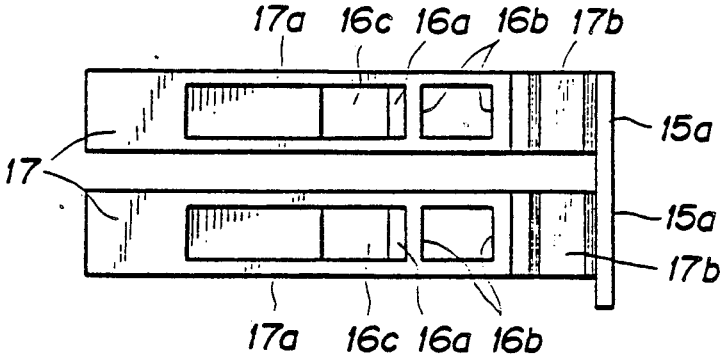
Figure 6:
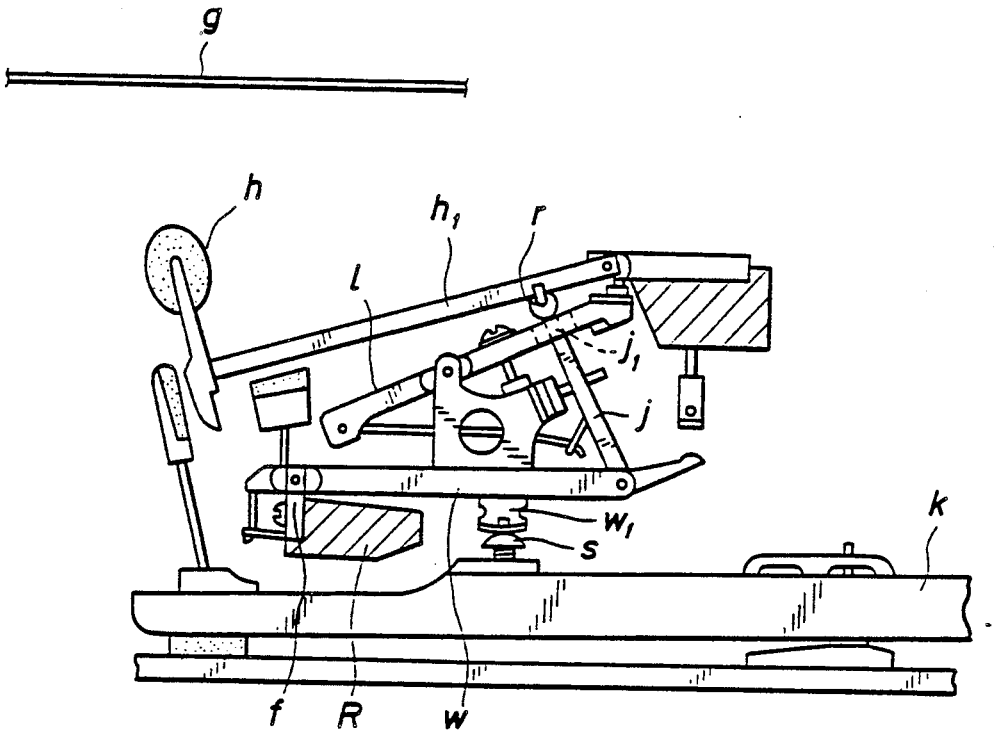
FIG. 6 is a side view showing a conventional piano action mechanism.

FIGS. 3 to 5 illustrate an embodiment in which the invention is adapted to a piano of the table-top type. In this case, the central portion of the key 11 is arranged to swing up and down on a balance rail 21 provided at a front portion of a bottom plate $F_1$ of a housing F. To the rear end of the key 11 is attached the lower end of a vertical rod-like jack 13 via a flexible piece 14 which is shorter and thinner than the jack 13 maintaining a freedom of displacement back and forth.

Over the rear half portion of the key 11, furthermore, a vertically directed shank flange 15a is forcibly fitted from the lower side into a hammer shank rail 15 dispersed to at right angles relative to key 11 and which is downwardly directed E-shape cross section. As will be obvious from FIGS. 4 and 5, the shank flange 15a is composed of a synthetic resin and is formed together with a hammer shank 17a and a hammer 17 as a unitary structure via a thin flexible piece 17b that serves as a pivot portion. The hammer shank 17a has the shape of an elongated groove, and the thin flexible piece 17b has on the rear side thereof a downwardly directed push-out protrusion 16b, a jack receiver 16a neighboring thereto, and a window 16c into which the upper end of the jack 13 enters.

The hammer body, inclusive of the shank flange 15a, may be constructed as a single unit. Or, a plurality of hammer bodies may be coupled together at a portion of the flange 15a as shown in FIG. 5(*b*).

When the piano is not being played, the hammer 17 is held by a plate-like backcheck member 19 that is erected from the bottom plate $F_1$ to maintain the hammer shank 17a in nearly the horizontal condition such that the upper end of the jack 13 is opposed to the lower side of the jack receiver 16a on the lower surface of the shank 17a maintaining a small distance.

Symbol g' denotes a sound producing member which consists of a pipe or a plate supported between the hammer shank rail 15 and the housing F via cushioning members.

Being constructed as described above, when the front end of the key 11 is depressed, the rear half portion moves upwards as indicated by phantom lines in FIGS. 3 and 4, the jack 13 coupled to the rear end via the flexible piece 14 moves up as a matter of course, and the upper end of the jack 13 comes into engagement with the jack receiver 16a on the lower surface of the hammer shank as indicated by the phantom line in FIG. 4 to knock up the hammer shank 17a.

Then, the hammer shank 17a and the hammer 17 swung upward as shown by the phantom line in FIG. 4 with the thin flexible piece 17b functioning as a pivot mount or fulcrum of turn. Accompanying the turn, the push-out protrusion 16b positioned neighboring the jack receiver 16a hits the upper end of the jack 13 to turn it rearwardly (in the counterclockwise direction) against the resilient force of the flexible piece 14, whereby the jack 13 is positively disengaged, i.e., let off, from the jack receiver 16a, which gives a peculiar key touch feeling to the player, and the hammer 17 moves quickly, by inertia, toward the sound producing member g' to hit it.

When the hand is separated away from the key, the key 11 returns again to the condition of solid line accompanying the jack 13. Faster than this, however, the hammer 17 and the hammer shank 17a return to their initial positions. In this case, the upper end of the jack 13 enters into the window 16c formed in the shank 17a, and restoration operation of the hammer 17 is not interrupted.

According to the piano action mechanism of the present invention as described above, the jack is rotatably mounted on the rear portion of the key in a resiliently urged manner, a jack receiver and a push-out protrusion are formed on a hammer support member which is rotatably mounted at its end on the hammer shank rail that is provided over the key, and the engagement between the jack and the jack receiver is released by the push-out protrusion when the key is depressed. Therefore, the construction is very simplified without using such parts as wippen, wippen rail, wippen heel and capstan screw that were so far necessary. Namely, the number of parts is decreased, the adjustment can be easily done and the mechanism can be easily fabricated yet without impairing touch feeling in depressing the key.

What is claimed is:

1. A piano action including, in combination, a hammer having a horizontal shank including a base end mounted for free angular displacement to swing said hammer, in a vertical plane between rest and actuated positions, an elongated horizontal key having a first finger engagable end and a second hammer actuating end and mounted, intermediate its opposite ends, beneath said shank for rocking oscillatory movement of said key in a vertical plane between first and second limit positions, said second end including an upstanding jack, having upper and lower ends, supported therefrom and displaced upwardly toward said base end during movement of said key from said first position toward said second position, the lower end of said jack being supported from said second end for limited angular displacement of said upper end toward and away from said base end and yieldingly biased toward said base end, said shank base end defining a substantially right angle seat including a first portion extending along said shank and facing downward toward and engagable by the upper end of said jack and a second horizontally facing portion defining an abutment spaced below said first portion and facing along a path extending beneath said first portion and toward said hammer, said upper end, when said key and hammer are in said first and rest positions, respectively, being spaced below said first portion and engagable with the said first portion during initial upward movement of said second end of said key toward said second position, for elevating said first portion, and thus swinging said hammer from said rest position toward said actuated position, upon movement of said hammer past a predetermined position between said rest and actuated positions, said second portion being operable to engage said upper end and to angularly displace the said upper end toward said hammer and out of engagement with said first portion, to thereby allow said hammer to return to said rest position independent of return movement of said key to said first position.

2. The piano action of claim 1 wherein said second portion is adjustably supported from said shank for shifting along a path generally paralleling said shank.

3. The piano action of claim 1 wherein the lower end of said jack is pivotally supported from said key.

4. The piano action of claim 3 wherein the lower end of said jack includes a lateral leg, and a compression spring operatively associated with said leg and key yieldingly biasing said jack upper end toward said base end.

5. The piano action of claim 1 wherein said lower end and key second end are integrally joined.

6. The piano action of claim 1 wherein said second portion is fixedly supported from said shank.

* * * * *